US009153872B2

(12) United States Patent
Gebretnsae

(10) Patent No.: US 9,153,872 B2
(45) Date of Patent: Oct. 6, 2015

(54) RADIATION ELEMENT RETAINER DEVICE

(75) Inventor: Mussie Gebretnsae, Göteborg (SE)

(73) Assignee: SAAB AB, Linköping (SE)

( * ) Notice: Subject to any disclaimer, the term of this patent is extended or adjusted under 35 U.S.C. 154(b) by 290 days.

(21) Appl. No.: 13/518,431

(22) PCT Filed: Dec. 22, 2009

(86) PCT No.: PCT/SE2009/051487

§ 371 (c)(1),
(2), (4) Date: Aug. 30, 2012

(87) PCT Pub. No.: WO2011/078753

PCT Pub. Date: Jun. 30, 2011

(65) Prior Publication Data

US 2012/0313835 A1 Dec. 13, 2012

(51) Int. Cl.

| | |
|---|---|
| ***H01Q 21/00*** | (2006.01) |
| ***H01Q 21/06*** | (2006.01) |
| ***H01Q 1/12*** | (2006.01) |

(52) U.S. Cl.

CPC ..... *H01Q 21/0087* (2013.01); *H01Q 1/1207* (2013.01); *H01Q 21/061* (2013.01)

(58) Field of Classification Search

CPC ..... H01Q 1/125; H01Q 1/1207; H01Q 21/061–21/068

USPC ..... 343/797, 879, 892

See application file for complete search history.

(56) References Cited

U.S. PATENT DOCUMENTS

| | | | | |
|---|---|---|---|---|
| 3,216,580 | A | 11/1965 | Fricker | |
| 4,477,135 | A | 10/1984 | Pronto | |
| 5,499,035 | A | 3/1996 | Smith, Jr. et al. | |
| 6,034,649 | A * | 3/2000 | Wilson et al. | 343/795 |
| 7,106,268 | B1 * | 9/2006 | Angelucci | 343/797 |
| 7,109,943 | B2 * | 9/2006 | McCarville et al. | 343/797 |
| 7,129,908 | B2 * | 10/2006 | Edward et al. | 343/878 |
| 7,193,578 | B1 | 3/2007 | Harris et al. | |
| 2005/0078046 | A1 | 4/2005 | Theobold et al. | |
| 2005/0219140 | A1 | 10/2005 | Browne et al. | |

FOREIGN PATENT DOCUMENTS

EP 1921707 A1 5/2008

OTHER PUBLICATIONS

PCT/ISA/210—International Search Report—Aug. 25, 2010.

PCT/ISA/237—Written Opinion O The International Searching Authority—Aug. 25, 2010.

European Search Report—May 17, 2013—Issued in Counterpart Application No. 09852654.4.

* cited by examiner

*Primary Examiner* — Robert Karacsony
*Assistant Examiner* — Daniel J Munoz
(74) *Attorney, Agent, or Firm* — Venable LLP; Eric J. Franklin

(57) ABSTRACT

An antenna system including a radiation element retainer device including an attachment element configured to attach a radiation element to the radiation element retainer device. An attachment element attaches one radiation element to the radiation element retainer device. The radiation element retainer device is configured to be arranged with a circuit board carrier, such that the radiation element is electrically connectable to a circuit board, arranged at the circuit board carrier, as the radiation element is fixed on the radiation element retainer device by the attachment elements. The antenna system further includes a main board and a plurality of sets of attachment elements. The attachment elements are integrated formed with the retainer device, such that the attachment elements and the main board include one single piece of material that forms the radiation element retainer device.

11 Claims, 8 Drawing Sheets

RADIATION ELEMENT RETAINER DEVICE

CROSS-REFERENCE TO RELATED APPLICATIONS

This is the national phase under 35 U.S.C. §371 of PCT/SE2009/051487 filed 22 Dec. 2009.

TECHNICAL FIELD

This invention relates to an antenna system comprising numerous radiation elements.

BACKGROUND ART

An Active Electronically Scanned Array (AESA) is composed of numerous radiation elements. Due to the numerous radiation elements the AESA can be directed in a desired direction, by using a number of different frequencies of coherent radio energy that interfere constructively at certain angles in front of the antenna.

To achieve the desired effect, that the radio energy, from the individual radiation elements, interfere constructively the radiation elements must be positioned with an exact predetermined distance relative each other. Normally, each radiation element is mounted at circuit board carrier which then includes a number of radiation elements with Transmittal Receiver Modules (TRM), distribution network, power and logic. The radiation elements are mounted directly at the circuit board carrier or at a separate board which then can be mounted on the circuit board carrier. The high precision required in the mounting of the individual radiation elements relative each other, results in complex mounting solutions, and thereby high costs for the manufacturing of the mechanics, the mounting of the radiation elements and the handling of the all the involved parts.

The mounting solutions used so far in the AESA, are similar to the ones used for holding and supporting of circuit boards. With this background, the U.S. Pat. No. 4,477,135 is considered as closest prior art and discloses a attachment element for mounting and holding a printed circuit board onto a support panel, another printed circuit board or the like. The attachment element has a unitary flange extending outwardly from it; this unitary flange is used to attach the attachment element to a support panel or another printed circuit board, as by welding. To mount numerous radiation elements with the attachment element of U.S. Pat. No. 4,477,135 with the high precision needed for the use in a AESA would be very time consuming and expensive, since at least two unitary retainers has to be welded with high precision for each radiation element.

SUMMARY OF THE INVENTION

Therefore the object of the present invention is to provide an antenna system, in which the radiation elements can be attached in a secure way and with a high precision at a low cost.

The antenna system according to this invention comprises numerous radiation elements, at least one circuit board carrier, at least one circuit board and at least one radiation element retainer device. Said radiation element retainer device comprising an attachment means, which attaches one radiation element to the radiation element retainer device such, that said radiation element can be electrically connected to the at least one circuit board which is arranged on the at least one circuit board carrier. The invention is characterised in, that the radiation element retainer device further comprising a main board on which the attaching means is located and that one radiation element retainer device comprising a plurality of attachment means, whereby said attachment means are integrally formed with the main board, such that the attachment means and the main board consists of one single piece of material. The attachment means and the main board together forms the radiation element retainer device.

Due to the presented inventive construction of the antenna system, with a radiation element retainer device, a plurality of radiation elements can be quickly and with high precision mounted and fixed to the main board. The position of the individual radiation elements, mounted on the radiation element retainer device, relative the neighbouring radiation element is fixed. Thereby, the needed accuracy in the positioning of the radiation elements relative each other is guaranteed and this, to low cost and in a fast mounting procedure. No additional positioning or fixing procedure (i.e. welding, screwing, etc.) is needed, when mounting of the radiation elements.

Obviously, there are numerous alternative ways to construct the single attachment means to achieve a fixation of the radiation element. This invention is not limited to one of them, rather does it include all attachment means suitable to be integrally constructed with the main board of the radiation element retainer device, such that the main board and the attachment elements consists of one single piece of material. One specific construction of the individual attachment elements is shown in the figures, several other constructions my though be suitable.

The attachment means of the radiation element retainer device positions the radiation elements in the X-, Y- and Z-direction, wherein the X-, Y- and Z-direction are perpendicular to each other. Thereby, the radiation elements are secured in all directions, such that they are positioned with low tolerances with a predetermined distance to each other. Further, the radiation elements are fixed by the attachment means such that they can stand disturbances which can occur in a rough surrounding, such as an aircraft flying in turbulence, or a ship in stormy water.

Further, the radiation element retainer device is fabricated as of a ductile and/or flexible material such as metal, a polymer, a carbon fibre or the like. Thereby can the attachment means be formed such that a snap-fit connection between the radiation element and the attachment means can be realised, where applicable. Whereby a corresponding snap fit means is formed on the radiation elements. Still, another possibility is that the radiation element retainer device is fabricated in a stiff material, and the radiation element is ductile and/or flexible, at least at the attachment points, such that a snap-fit between the two is possible.

In an embodiment of the invention, the radiation element retainer device is made out of a single piece of metal sheet. The profile of the attachment means can thereby be cut out from the metal sheet, such that they can be bended into the required position to receive the radiation element. The cutting and bending has to be done with high precision, because of the low tolerances for the distance between the radiation elements. Such a cutting method could be laser cutting or alternatively a high precision mechanical cutting or even punching method. Naturally, the bending of the material must also be done with corresponding high precision to achieve the desired low tolerances of the end product. A preferred materiel for the radiation element retainer device is thin steel, with high flexibility; a plastic material is also a possibility. Further materials which could be suitable are aluminium, aluminium alloy and other light weight metallic materials.

Alternatively, the radiation element retainer device can be made out of a polymeric material. The whole radiation element retainer device can thereby be injection moulded into the required form. Thereby, the required form of the attachment means and the main board is achieved immediately, without any need for extensive finishing treatments.

Further, the radiation element retainer device and the attachment means can alternatively be made out of carbon fibre.

Further, the circuit board carrier can be integrated with the radiation element retainer device, such that it is made out of the same piece of material (independent of the choice of material and manufacturing method of the radiation element retainer device). Thereby can another step in the production of the AESA be eliminated, since the radiation element retainer device, does not have to be placed and fixed to the carrier board.

Still further, independent of the choice of material and manufacturing method, the carrier board could alternatively be hollow. Whereby, a ventilation system and/or cooling fluid conduit can be arranged in the hollow interior of the carrier board.

For all embodiments of the radiation element retainer device, the attachment means are arranged in one row at radiation element retainer device, such that when the radiation elements are mounted on the main board, the radiation elements are arranged in a row. Further, the attachment means can be arranged in a plurality of rows on the radiation element retainer device and thereby create a matrix of attachment means. The position of one attachment means in one row can be equal to the corresponding attachment means in a neighbouring row. Alternatively, the position of the attachment means in one row can be displaced relative the corresponding attachment means in a neighbouring row, such that a triangular matrix is created. The more attachment means that can be arranged on one radiation element retainer device, i.e. number of radiation elements that can be mounted on the radiation element retainer device, the faster and easier can the mounting of the numerous radiation elements on one radiation element retainer device, in the AESA be done. Further, a high number of attachment means secures a correct distance between all the radiation elements mounted on that radiation element retainer device. Thereby are sources of errors which occur in the seams between two radiation element retainer devices minimized.

To adjust the radiation element retainer device to be fitted in different surroundings, i.e. a wing of an aircraft of in a spherical radome, etc, it is provided that that the radiation element retainer device is curved in one or two directions, such that radiation element retainer device has the form of a cylinder segment or sphere segment.

To realise that the distance between a radiation element mounted last in a row at the radiation element retainer device has a predetermined distance to a neighbouring radiation element mounted at a neighbouring radiation element retainer device, the radiation element retaining device has fitting means arranged at its edges. The fitting means are thereby arranged in such way, that two neighbouring radiation elements mounted in their respective attachment means, at two different neighbouring radiation retainer devices, are at a specific predetermined distance from each other. The predetermined distance is preferably the same distance as the distance between two radiation elements mounted in the same row at the same radiation element retainer device.

The inventive antenna system presented above secures that the numerous radiation elements are mounted at their respective position with the high tolerances needed. The mounting can be performed quickly and to a low cost.

DETAILED DESCRIPTION OF THE DRAWINGS

Figure 1:
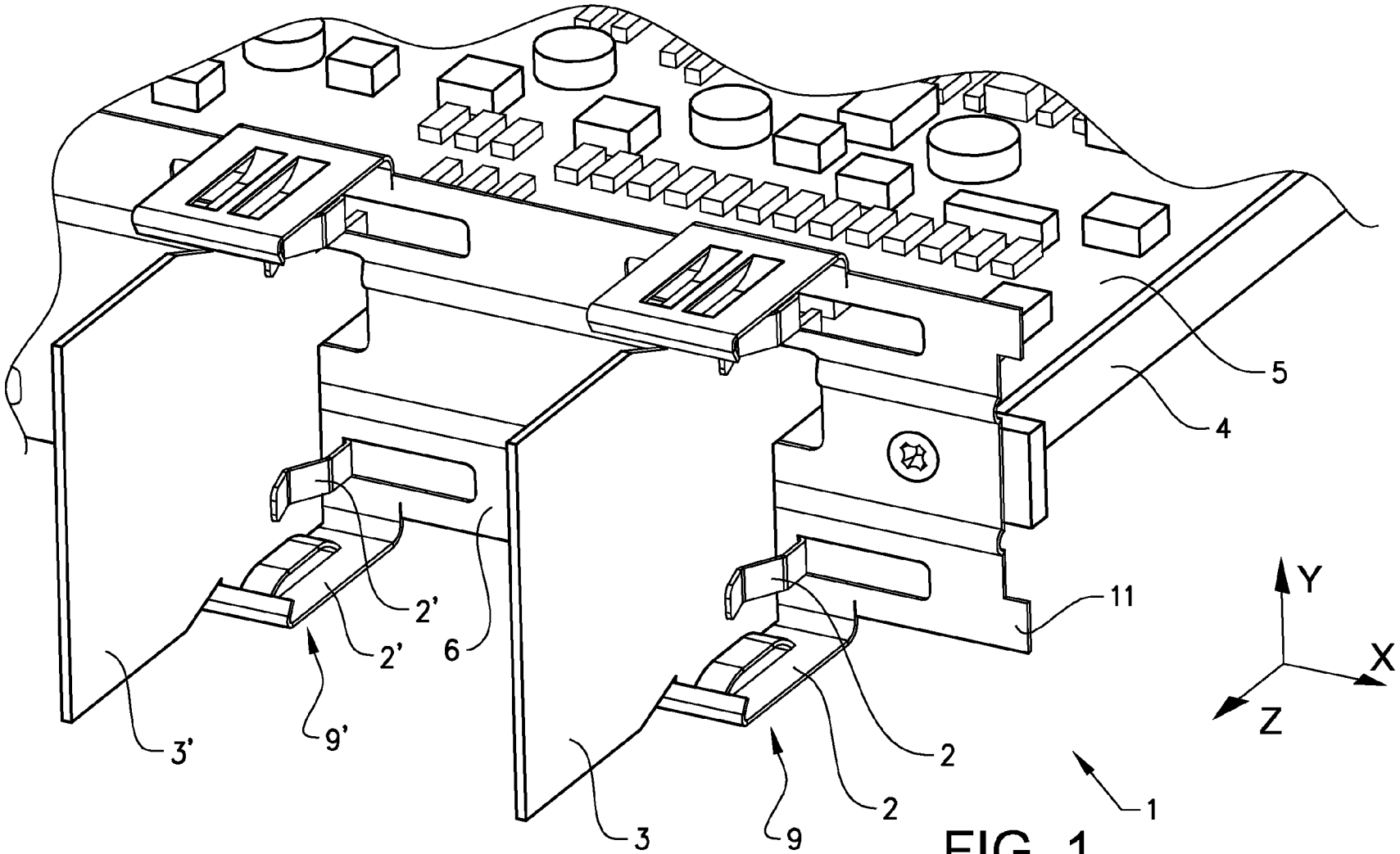
FIG. 1 discloses a schematic view of a radiation element retainer device.
Figure 2:
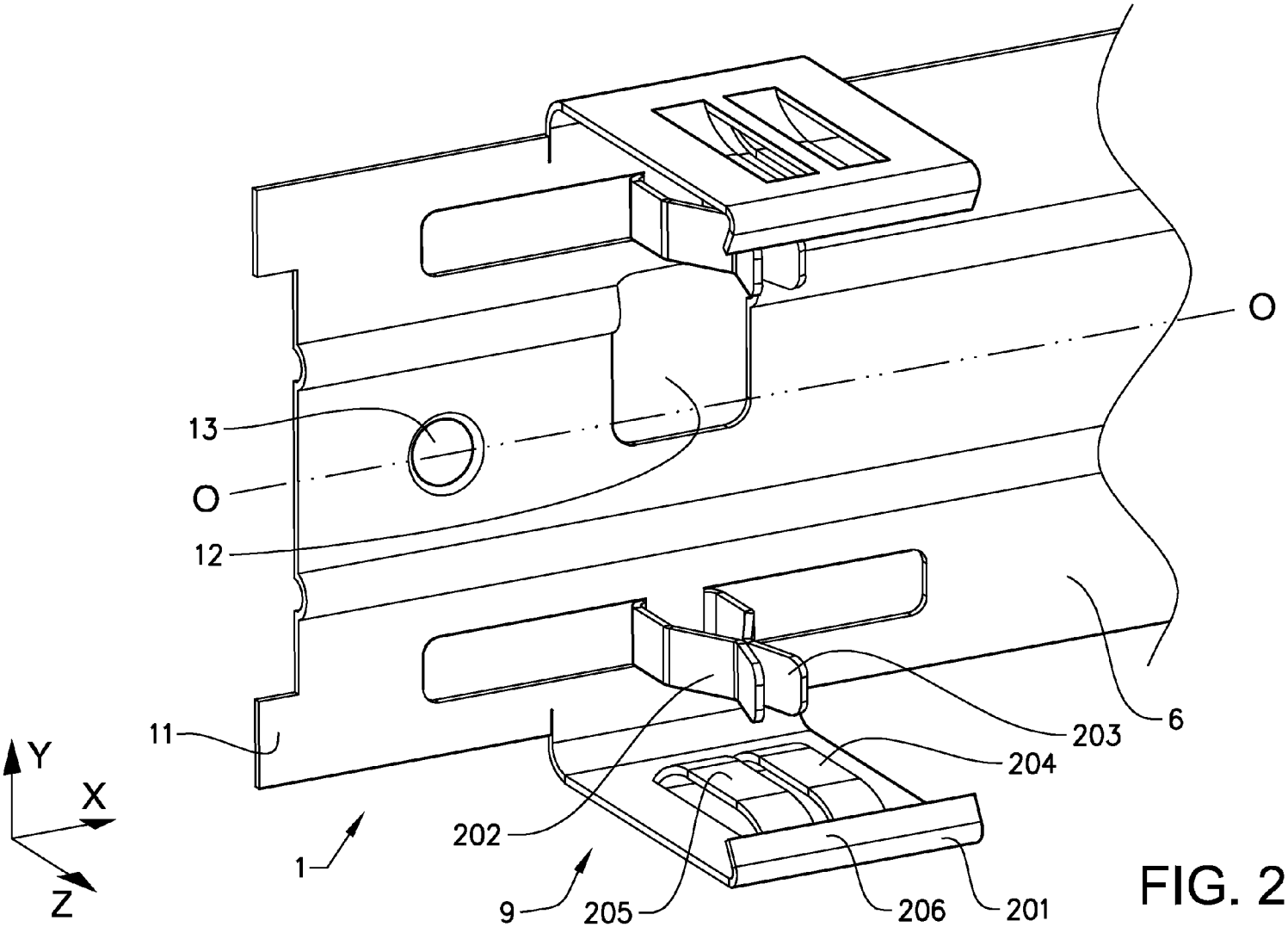
FIG. 2 discloses schematic close up view of the attachment means.

In FIG. 1 is a schematic view of a part of an antenna system disclosed. The antenna system comprises a radiation element retainer device 1, numerous radiation elements 3 (wherein just two is shown), at least one circuit board carrier 4 and at least one circuit board 5. The radiation element retainer device 1 is mounted on the circuit board carrier 4, at which a circuit board 5 is mounted. The radiation element retainer device 1 comprises a main board 6 on which attaching means 2 are located, wherein the attaching means 2 are arranged in sets 9 and each set 9 of attaching means 2 is adapted to position and hold one radiation element 3. In FIG. 2, a set 9 of attaching means 2 is disclosed. In the left side of FIG. 1 a neighbouring set 9' of attachment elements 2' can be seen. Further, fitting means 11 is located at the end of the radiation element retainer device 1. By mating the fitting means 11 with a corresponding fitting means of a neighbouring radiation element retainer device (not shown in the figure), the fitting means 11 positions the radiation element retainer device 1 relative another radiation element retainer device, such that a predetermined distance between neighbouring sets 9 of attachment means 2 on different main boards 6 is achieved.

In FIG. 2, a piece of the radiation element retainer device 1 is shown. A set 9 of attaching means 2 is shown, which individual attaching elements 201, 202, 203 are symmetrically located on opposite sides of the symmetry line O, whereby the attaching elements 201, 202, 203 are numbered just at one side of the symmetry line O. In this embodiment a set 9 of attachment means 2 comprises two flange supports 201 located on opposite sides of the symmetry line O and two sets of clamping supports 202, 203, wherein the two sets of clamping supports 202, 203, are located on opposite sides of the symmetry line O. An alternative embodiment could have only one set of clamping flange supports 202, 203, wherein they then are located in the middle between the flange supports 201. An opening 12 is located on the main board 6 between the flange supports 201, through the opening can the radiation element 3 connected with a circuit board 5.

The flange supports 201 and the clamping supports 202, 203 are directed essentially perpendicular to the upper surface of the main board 6. As the radiation element 3 is fitted into the attaching elements 2, its lower end is guided into the correct position by the clamp supports 202, 203 and guiding means 204, 205 located on the flange supports 201. For this purpose the clamp supports 202, 203 have an upper shape such that the radiation element easily slides in between them. The mounted radiation element 3 is secured in the X-direction by the guiding means 204, 205 and the clamp supports 202, 203. A mounted radiation element 3 is fixed in the Z-direction by the flange support 201. The flange support 201 has a hook 206 at its upper part, said hook 206 and a corresponding notch in the radiation element 3 allows the radiation element 3 to be snap fitted into its position on the radiation element retainer device 1. In the Y-direction the radiation element 3 is positioned and fixed by flange supports 201 through the contact with the hook 206 and through contact along the side of the flange support 201 in between the two guiding means 204, 205. Further is an aperture 13 for fixing the radiation element retaining device 1 at for example a circuit board carrier provided.

Figure 3:
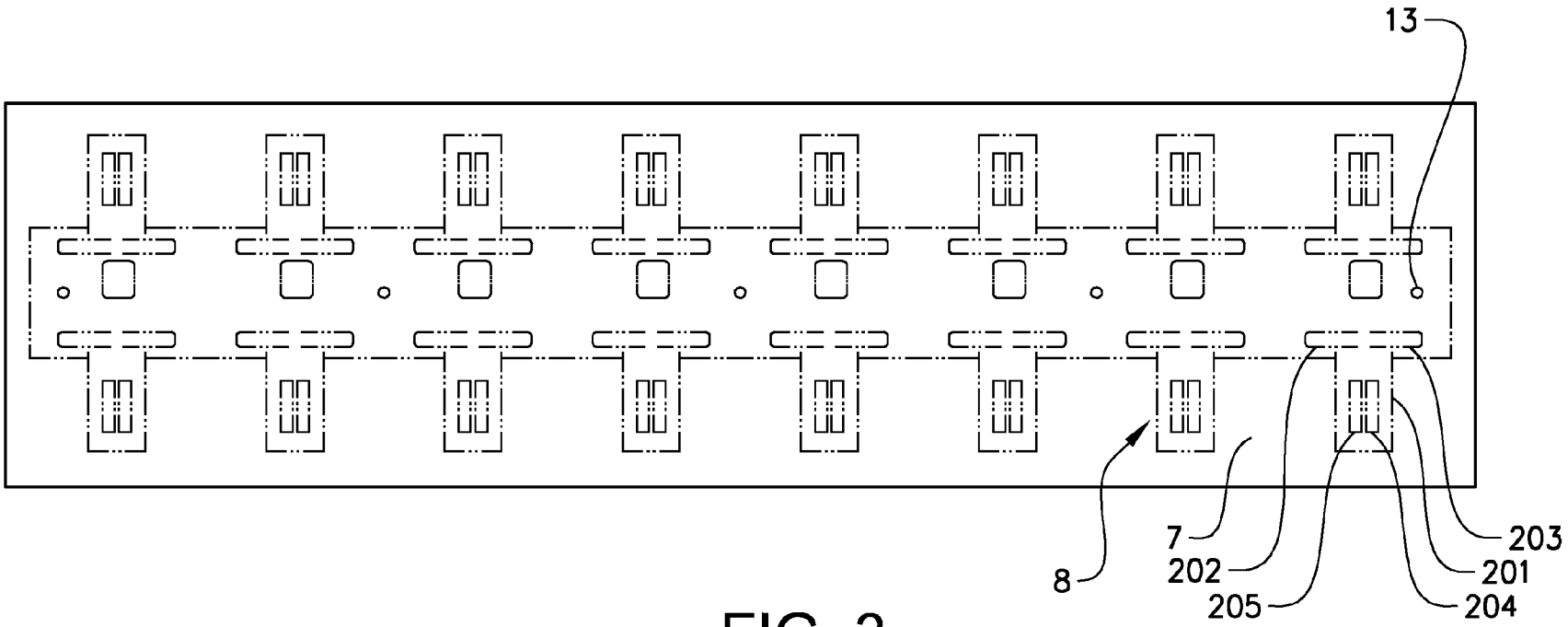
FIG. 3 discloses a piece of metal sheet with cut outs.

FIG. 3 shows a piece of metal sheet 7 in which an outlined cut out 8 is marked. As the cut out is performed and the waist material is removed, the attachment means 2 can be bended into their required form, such as shown in FIG. 2. Outlined cut out 8 shows the individual attachment elements 201-204 as well as the opening 12 and the aperture 13

Figure 4:
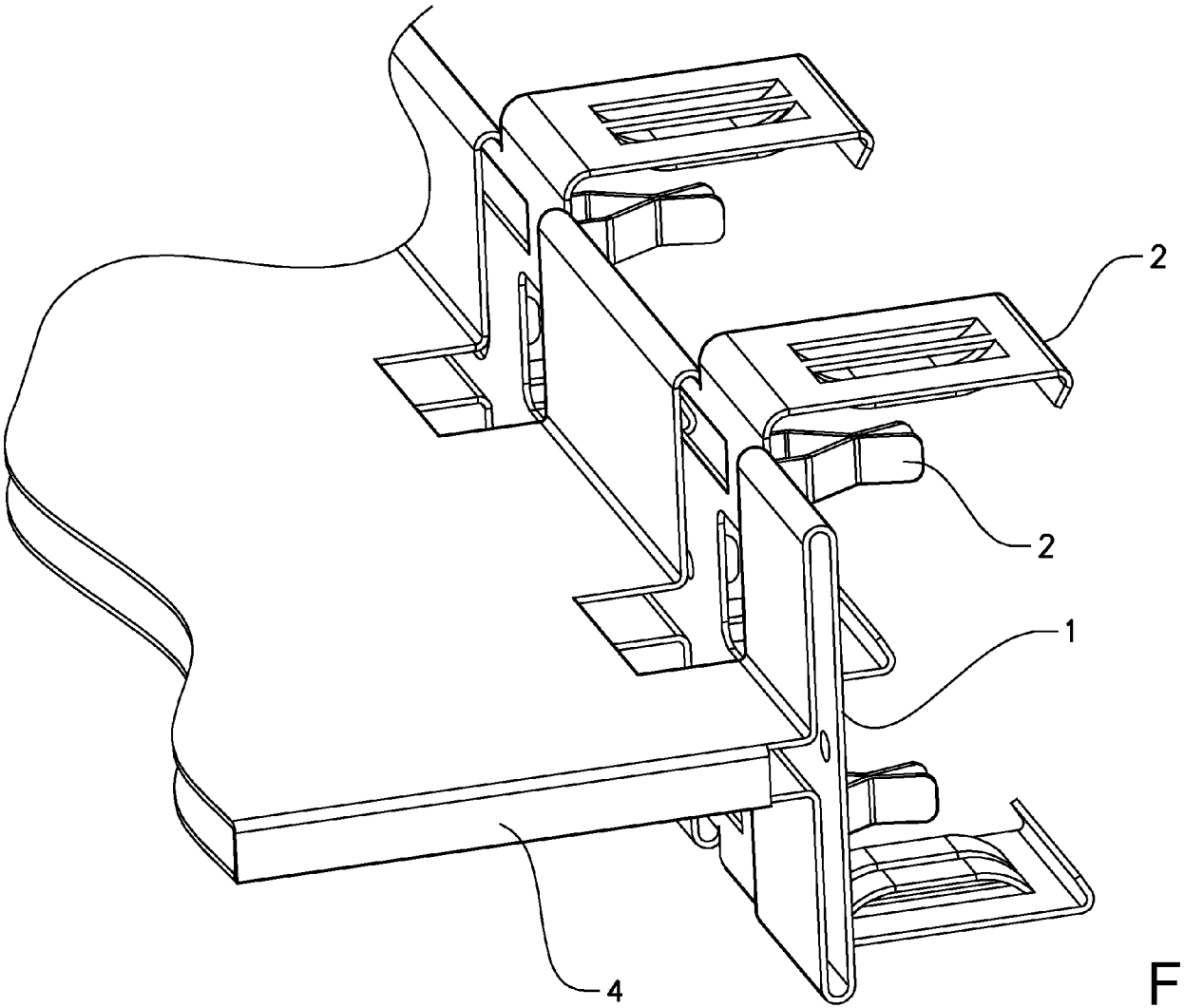
FIG. 4 discloses another schematic view of a radiation element retainer device with an integrally formed circuit board carrier.

FIG. 4 shows an embodiment of the radiation element attachment device 1, in which the circuit board carrier 4 is integrally formed with the main board 6. The shown embodiment could be made out of metal, plastic, carbon fibre or another suitable material. For a metal material the circuit board carrier 4 can be cut out in a similar process as the attachment means 2 are and thereafter bended into the shown form, as explained in conjunction with FIG. 3. With this construction a further step in the assembly process of the antenna system is saved, since the main board, not have to be positioned and mounted on the circuit board carrier 4.

Figure 5:
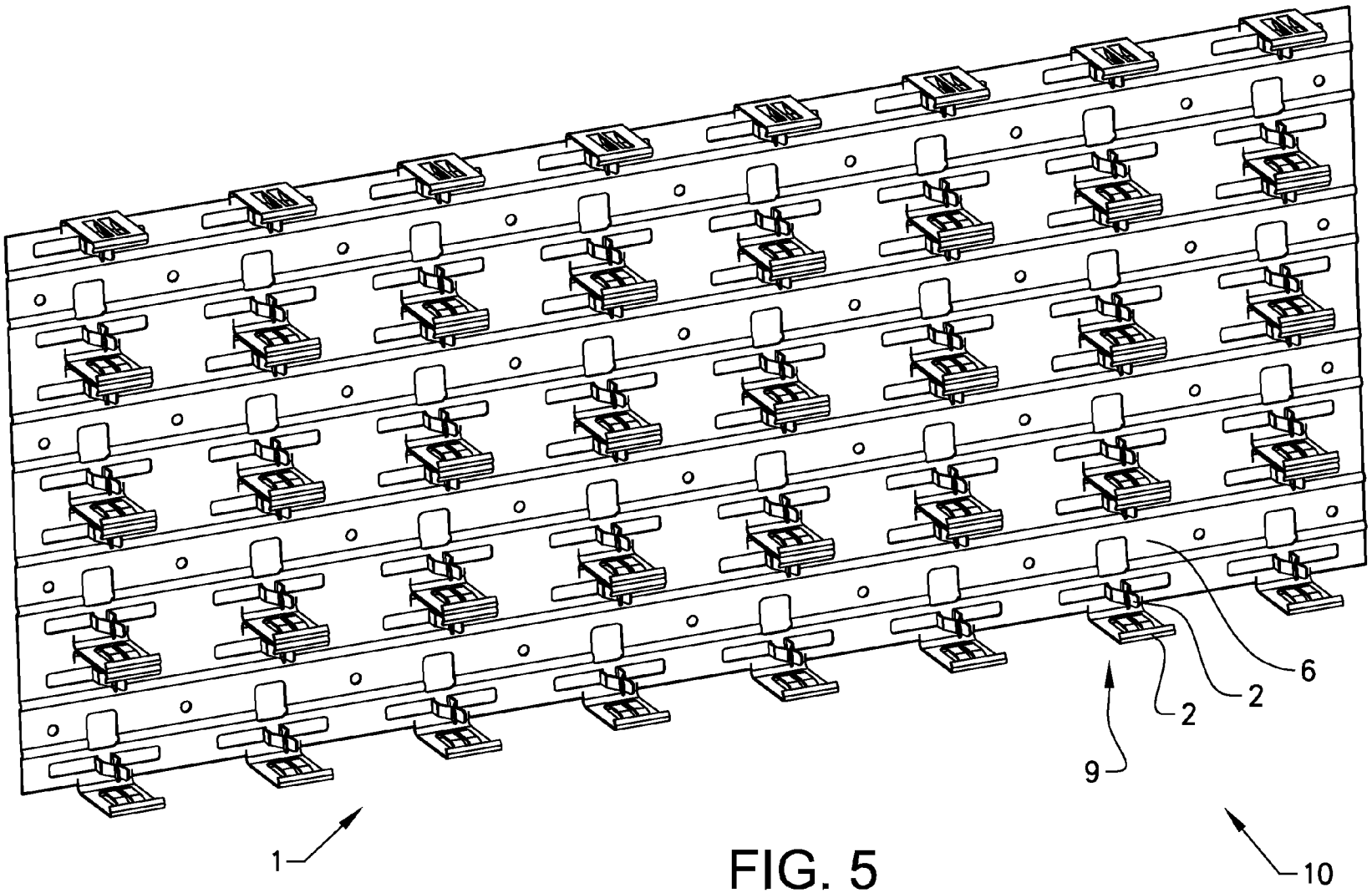
FIG. 5 discloses a schematic view of a radiation element retainer device in which the attachment means are arranged in a matrix.
Figure 6:
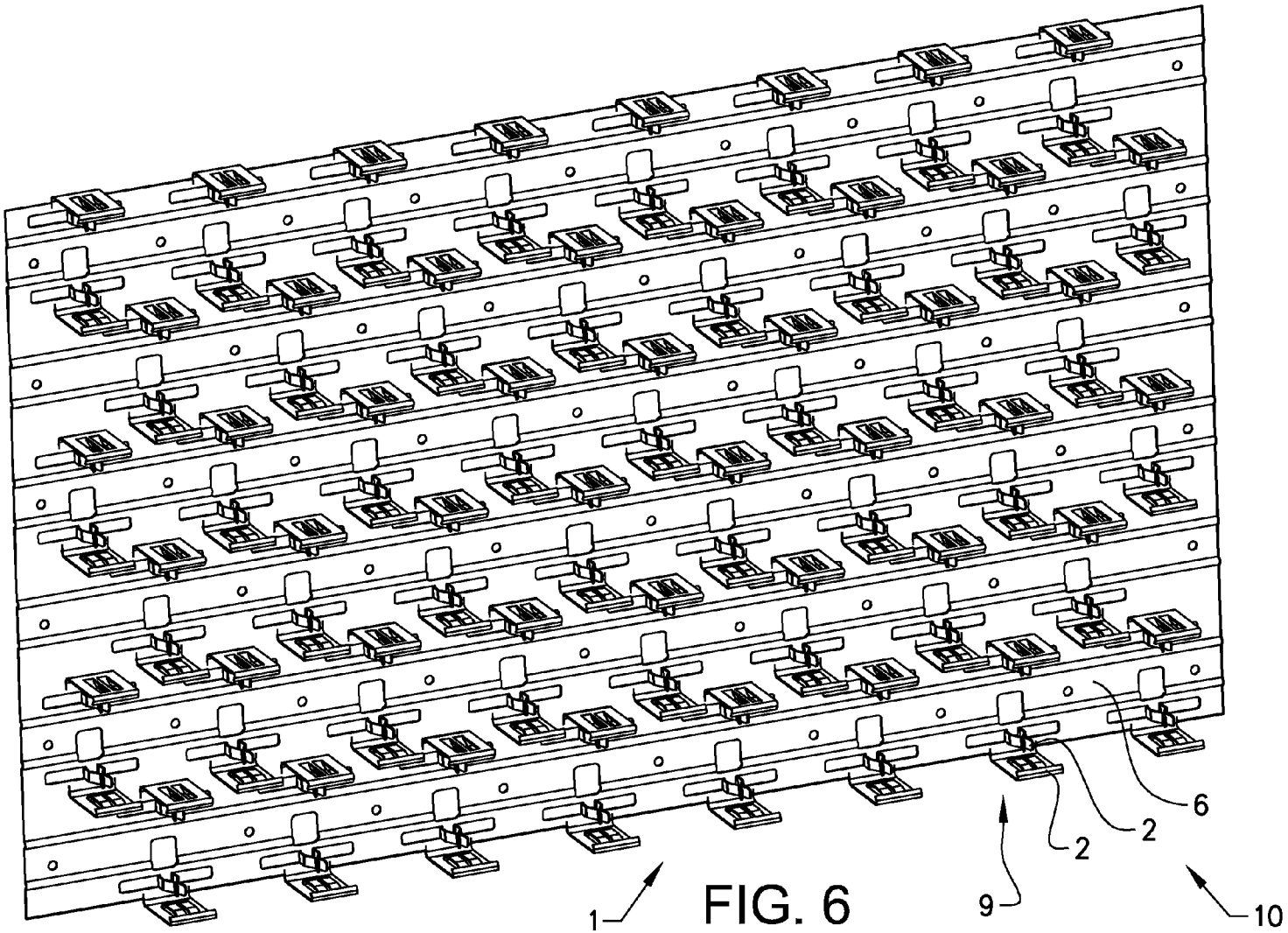
FIG. 6 discloses a schematic view of a radiation element retainer device with the attaching means arranged in a triangular matrix.

In FIG. 5 a radiation element retainer device 10 with a matrix of attachment means 2 shown. By making the main board 6 lager and thereby enabling more sets 9 of attachment means 2 to be located on the same main board 6, the risk of misplacing a radiation element retainer device 1 relative its neighbour is decreased, since fewer retainer devices 1 is needed to mount the same amount of radiation elements 1. In FIG. 6 a radiation element retainer device 10 is shown, which only differs from the radiation element retainer device 10 shown in FIG. 5 in, that the rows of attachment means 2 are displaced relative the corresponding attachment means in a neighbouring row, such that a triangular matrix is created.

Figure 7:
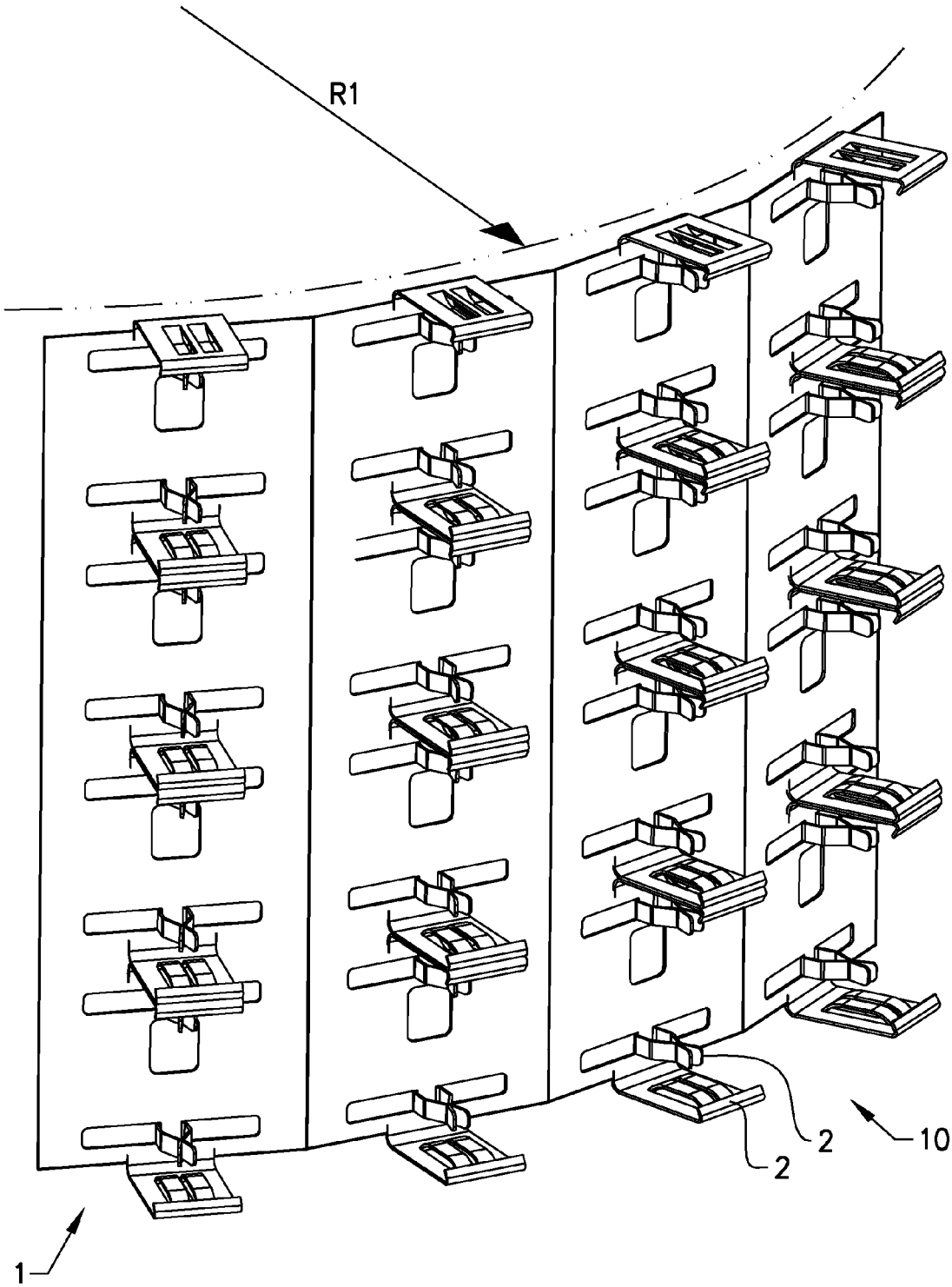
FIG. 7 discloses a schematic view of a radiation element retainer device which is bended in one direction.
Figure 8:
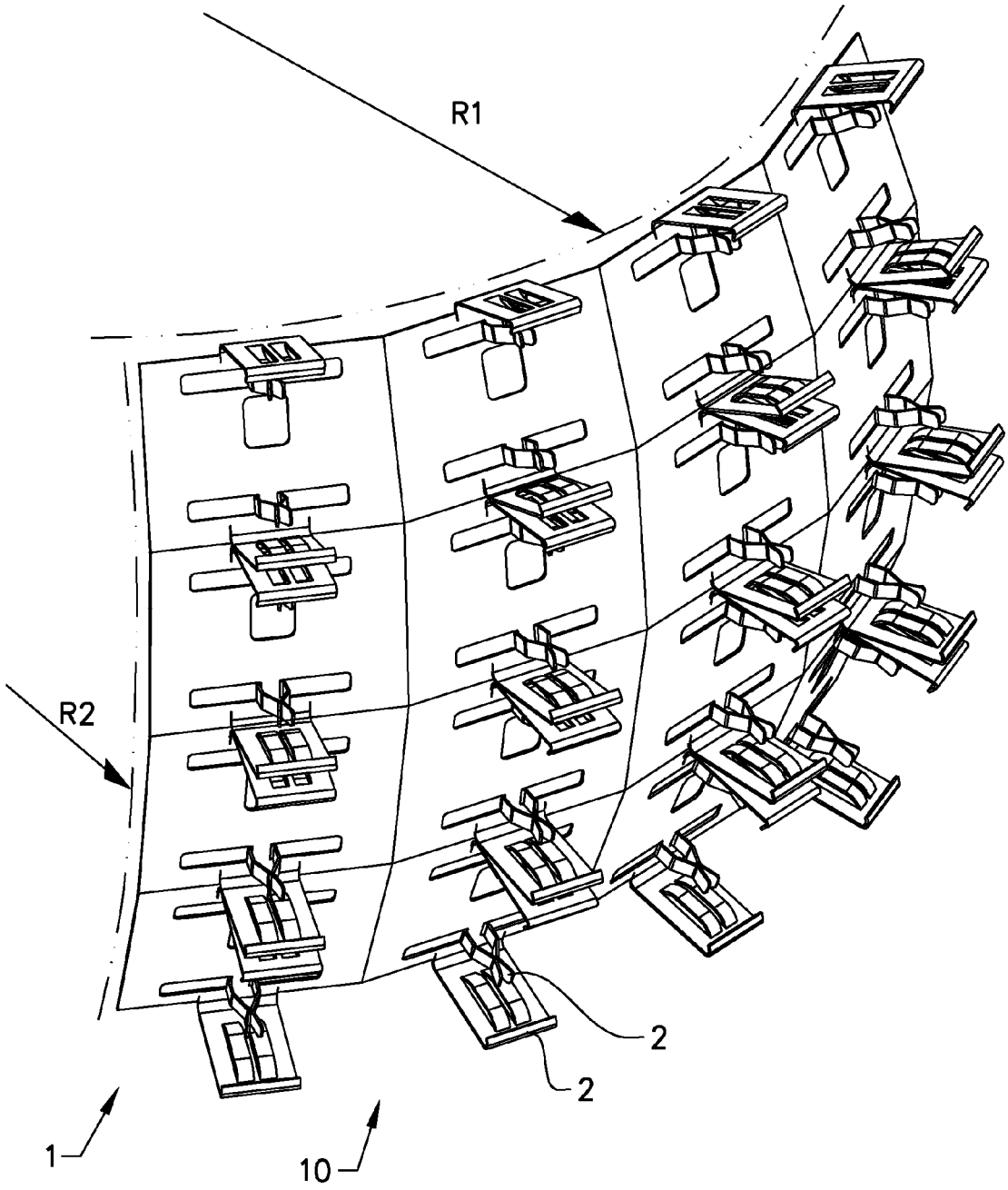
FIG. 8 discloses a schematic view of a radiation element retainer device which is bended in two directions.

FIGS. 7 and 8 also shows a radiation element retainer device 10 with a matrix of attachment elements 2 arranged at a main board 6. In FIG. 7, the main board 6 is curved in one direction, such that it forms a cylinder segment with the radius R1. Due to the form of a cylinder segment, the radiation element retainer device 10 can be mounted close to curved surfaces, such within the interior of an airplane wing. In FIG. 8, the radiation element retainer device 10 is curved in two directions, such that it has two bending radiuses, R1, and R2. Whereby when R1 is equal R2, the radiation element retainer device 10 forms a sphere segment and then radiation element retainer device 10 can be mounted close to surfaces curved in two directions, such as a radome.

The invention claimed is:

1. An antenna system, comprising:

a plurality of radiation elements, at least one circuit board carrier, at least one circuit board arranged on the at least one circuit board carrier, and at least one radiation element retainer device, said at least one radiation element retainer device comprising a plurality of attachment elements configured to attach one radiation element to the radiation element retainer device, such that said radiation element can be electrically connected to the at least one circuit board, the radiation element retainer device comprising a main board on which the attaching elements are located, whereby said attachment elements are integrally formed with the main board, such that the attachment elements and the main board comprise one single piece of sheet material, wherein each attachment element for one radiation element comprises a first flange support and a second flange support arranged opposite the first flange support, such that the first flange support and the second flange support protrude substantially perpendicular to the main board and to the radiation element, whereby first flange support and the second flange support each comprise a hook at an end distal to the main board, wherein the hooks interact with a notch in the radiation element to lock the radiation element into position.

2. The antenna system according to claim 1, wherein each attaching element positions, holds and fixes one radiation element in an X-, Y- and Z-direction, wherein the X-, Y- and Z-directions are perpendicular to each other.

3. The antenna system according to claim 1, wherein the attachment elements are formed, such that the radiation elements can be snap-fit into position.

4. The antenna system according to claim 1, wherein the carrier board is attached to the side of the radiation element retainer device opposite the attachment element.

5. The antenna system according to claim 4, wherein the carrier board is hollow, such that a ventilation system and/or a cooling fluid conduit can be arranged in the hollow interior of the carrier board.

6. The antenna system according to claim 4, wherein the carrier board is integrally formed with the radiation element retainer device, such that the carrier board and the radiation element retainer device comprise one single piece of material.

7. The antenna system according to claim 4, wherein the carrier board is detachable attached to the radiation element retainer device.

8. The antenna system according to claim 1, wherein the attachment elements are arranged in one row on the radiation element retainer device.

9. The antenna system according to claim 1, wherein the attachment elements are arranged in a plurality of rows on the radiation element retainer device, such that a matrix of attachment elements is created, wherein the matrix can be a rectangular matrix or a triangular matrix.

10. The antenna system according to claim 1, wherein the radiation element retainer device is curved in at least one direction, such that the radiation element retainer device has the form of a cylinder segment or sphere segment.

11. The antenna system according to claim 1, wherein the antenna system comprises a plurality of radiation element retainer devices, the antenna system further comprising:

fittings arranged on at least one edge of the radiation elements retainer devices, wherein the fittings locate two neighboring radiation retainer devices in their correct position relative each other, such that as two neighboring radiation elements, are at a specific predetermined distance from each other, wherein said two neighboring radiation elements are located at different neighboring radiation retainer devices.

* * * * *